US008596178B2

(12) United States Patent
Rogers et al.

(10) Patent No.: US 8,596,178 B2
(45) Date of Patent: Dec. 3, 2013

(54) EXPANDING COUNTERMEASURE AND LAUNCHER SYSTEM

(75) Inventors: Eldon C. Rogers, Auburn, WA (US); Timothy L. Williams, Burien, WA (US); Dennis Yee, Mill Creek, WA (US); William J. Sweet, Seattle, WA (US); Charles G. Bloch, Federal Way, WA (US)

(73) Assignee: The Boeing Company, Chicago, IL (US)

( * ) Notice: Subject to any disclaimer, the term of this patent is extended or adjusted under 35 U.S.C. 154(b) by 236 days.

(21) Appl. No.: 13/016,608

(22) Filed: Jan. 28, 2011

(65) Prior Publication Data

US 2012/0192707 A1 Aug. 2, 2012

(51) Int. Cl.
*F41H 5/007* (2006.01)

(52) U.S. Cl.
USPC ..... 89/1.11; 89/36.17; 89/902; 102/502

(58) Field of Classification Search
USPC ..... 89/1.11, 36.17, 902; 102/504, 502
See application file for complete search history.

(56) References Cited

U.S. PATENT DOCUMENTS

| | | | | |
|---|---|---|---|---|
| 4,912,869 | A | 4/1990 | Govett | |
| 5,750,918 | A * | 5/1998 | Mangolds et al. | 102/502 |
| 5,898,125 | A | 4/1999 | Mangolds et al. | |
| 5,988,036 | A | 11/1999 | Mangolds et al. | |
| 7,190,304 | B1 | 3/2007 | Carlson | |
| 7,398,617 | B2 * | 7/2008 | Mattox | 43/58 |
| 8,205,537 | B1 * | 6/2012 | Dupont | 89/1.34 |
| 2002/0134365 | A1 * | 9/2002 | Gray | 124/56 |
| 2006/0169832 | A1 | 8/2006 | Glasson | |
| 2007/0169616 | A1 | 7/2007 | Vickroy | |
| 2010/0307328 | A1 | 12/2010 | Hoadley et al. | |
| 2012/0210851 | A1 * | 8/2012 | Glasson | 89/1.8 |

FOREIGN PATENT DOCUMENTS

GB 2172853 A 3/1985

OTHER PUBLICATIONS

Shenzhen Xinyi Technology Co., Ltd., "Air-charged Catching Net," [http://www.ecplaza.net/trade-leads-seller/aircharged-catching-net--6447638.html] Accessed Jun. 20, 2012.
CoolestGadgets, "Shooting Net for Catching Thieves," [http://www.coolest-gadgets.com/20080402/shooting-net-for-catching-thieves/] Accessed Jun. 20, 2012.
Instructables, "Build a Net Gun," [http://www.instructables.com/id/Build-A-Net-Gun/] Accessed Jun. 20, 2012.
Jane's Intelligence and Insight You Can Trust, "Iraq's RKG Armour Threat," May 22, 2009.
Rkg-3 H.E.A.T. & UPG-8 Practice Hand Grenades, [http://www.inert-ord.net/russ02i/rkg3_upg8/index.html] Accessed Jun. 20, 2012.
Tactical Life, "Net Gun," [http://www.tactical-life.com/online/special-weapons/net-gun/] Accessed Jun. 20, 2012.
GB Combined Search and Examination Report dated May 18, 2012 in GB Application No. GB1201328.0.

* cited by examiner

*Primary Examiner* — Stephen M Johnson
(74) *Attorney, Agent, or Firm* — Hope Baldauff, LLC

(57) ABSTRACT

Systems and methods described herein provide for the protection of personnel within vehicles and structures from handheld grenades and other threats. According to one aspect of the disclosure provided herein, a countermeasure system includes an expandable countermeasure having a flexible body with a number of weighted projectiles attached around a perimeter of the body. A threat detection and launch control system detects incoming threats and, in response, triggers a launch of the expandable countermeasure from the launcher to intercept and neutralize the threat.

16 Claims, 9 Drawing Sheets

EXPANDING COUNTERMEASURE AND LAUNCHER SYSTEM

BACKGROUND

The armed forces experience numerous threats while performing their missions on a day to day basis on foreign soil. One of these threats is from hand-thrown grenades. Enemy forces are known to throw handheld shaped charge grenades, such as RKG-3 grenades, at tanks and other vehicles from close distances. These types of grenades strike the vehicle, igniting a shaped charge that is capable of penetrating the armor of many tanks and military vehicles.

One method for guarding against these types of threats is to mount fencing, screens, caging, or similar material on all surfaces of the vehicle, leaving a gap between the fencing and the vehicle armor. The idea behind this type of protective structure is that the grenade will strike the fencing and explode. The space between the protective fencing and the armor plating of the vehicle minimizes the effects of the shaped charge, preventing penetration of the vehicle armor. However, this type of protective fencing is cumbersome. It inhibits the views from the vehicle and slows ingress and egress in and out of the vehicle.

Another existing solution to handheld shaped charge grenades is to increase the armor thickness on the vehicle. Enhancing the vehicle armor, while increasing the survivability of a grenade attack, significantly increases the weight of the vehicle and does not prevent vehicle damage.

It is with respect to these considerations and others that the disclosure made herein is presented.

SUMMARY

It should be appreciated that this Summary is provided to introduce a selection of concepts in a simplified form that are further described below in the Detailed Description. This Summary is not intended to be used to limit the scope of the claimed subject matter.

Systems and methods described herein provide for the effective protection of a vehicle or other platform from a handheld grenade or similar threat. Utilizing the concepts described herein, incoming threats can be detected and nets or similarly expanding countermeasures can be launched from one or more applicable launchers to intercept and capture the incoming grenade or threat prior to impact with the vehicle.

According to one aspect of the disclosure provided herein, a countermeasure system includes an expandable countermeasure, a countermeasure launcher, and a threat detection and launch control system. The expandable countermeasure includes a flexible receiving body and a number of weighted projectiles. The countermeasure launcher may be attached to a vehicle, building, or other platform. The expandable countermeasure is stowed inside the countermeasure launcher until launched. The threat detection and launch control system detects incoming threats and triggers the launch of the countermeasure from the launcher to intercept the threat.

According to another aspect, a countermeasure system includes a number of expandable countermeasures and a number of corresponding countermeasure launchers. Each expandable countermeasure includes a flexible receiving body, around which a number of weighted projectiles are attached. Each countermeasure launcher has a cavity, a number of projectile barrels surrounding the cavity, and a firing mechanism for launching the countermeasures. The cavity holds the expandable countermeasure in a stowed configuration. The projectile barrels receive the weighted projectiles of the expandable countermeasure and, upon launching of the countermeasure, direct the weighted projectiles at an angle away from the cavity so that the flexible receiving body is pulled open or expanded by the weighted projectiles. The firing mechanism is connected to the projectile barrels so that when activated, the firing mechanism propels the weighted projectiles out of the tubes.

According to yet another aspect, a method for neutralizing an incoming threat to a vehicle with a countermeasure is provided. The method includes detecting the incoming threat approaching the vehicle and determining an approach zone from which the threat is approaching. One or more countermeasure launchers are selected from intercepting the incoming threat in that approach zone. An expandable countermeasure is launched from each of the selected countermeasure launchers and expands upon exiting the launcher thereby encompassing the incoming grenade or other threat and protecting the vehicle from a direct hit.

The features, functions, and advantages that have been discussed can be achieved independently in various embodiments of the present disclosure or may be combined in yet other embodiments, further details of which can be seen with reference to the following description and drawings.

BRIEF DESCRIPTION OF THE DRAWINGS

The present invention is illustrated by way of example and not limitation in the figures of the accompanying drawings, in which like references indicate similar elements and in which.

DETAILED DESCRIPTION

The following detailed description is directed to systems and methods for detecting and neutralizing an incoming threat such as a handheld grenade. As discussed briefly above, typical handheld shaped charge grenades, as well as any other types of grenades and munitions, provide a serious threat to armed forces. While all munitions are problematic for personnel and vehicles, handheld shaped charge grenades, such as the RKG-3, are particularly troublesome to troops in vehicles due to the ability for the shaped charge to penetrate vehicle armor. However, due to the nature of a shaped charge and how it operates, the corresponding grenade must impact the vehicle directly, and at as close to a 90-degree angle as possible, to inflict the greatest damage. Existing solutions either significantly increase the weight of the vehicle by increasing the thickness of the armor, which decreases the risk of complete armor penetration but does not prevent damage to the vehicle, or prevents the grenades from making direct contact using fencing that also significantly decreases visibility and inhibits vehicle ingress and egress.

However, utilizing the concepts and technologies described herein, vehicles may be protected with an active that detects incoming grenades and launches a countermeasure at the grenade to capture, detonate, and/or deflect the grenade before it impacts the vehicle. Using the embodiments disclosed below, the vehicle and its occupants are protected with little or no damage to the vehicle, no substantial increase in vehicle weight, and no impact to visibility and vehicle ingress/egress.

Figure 1:
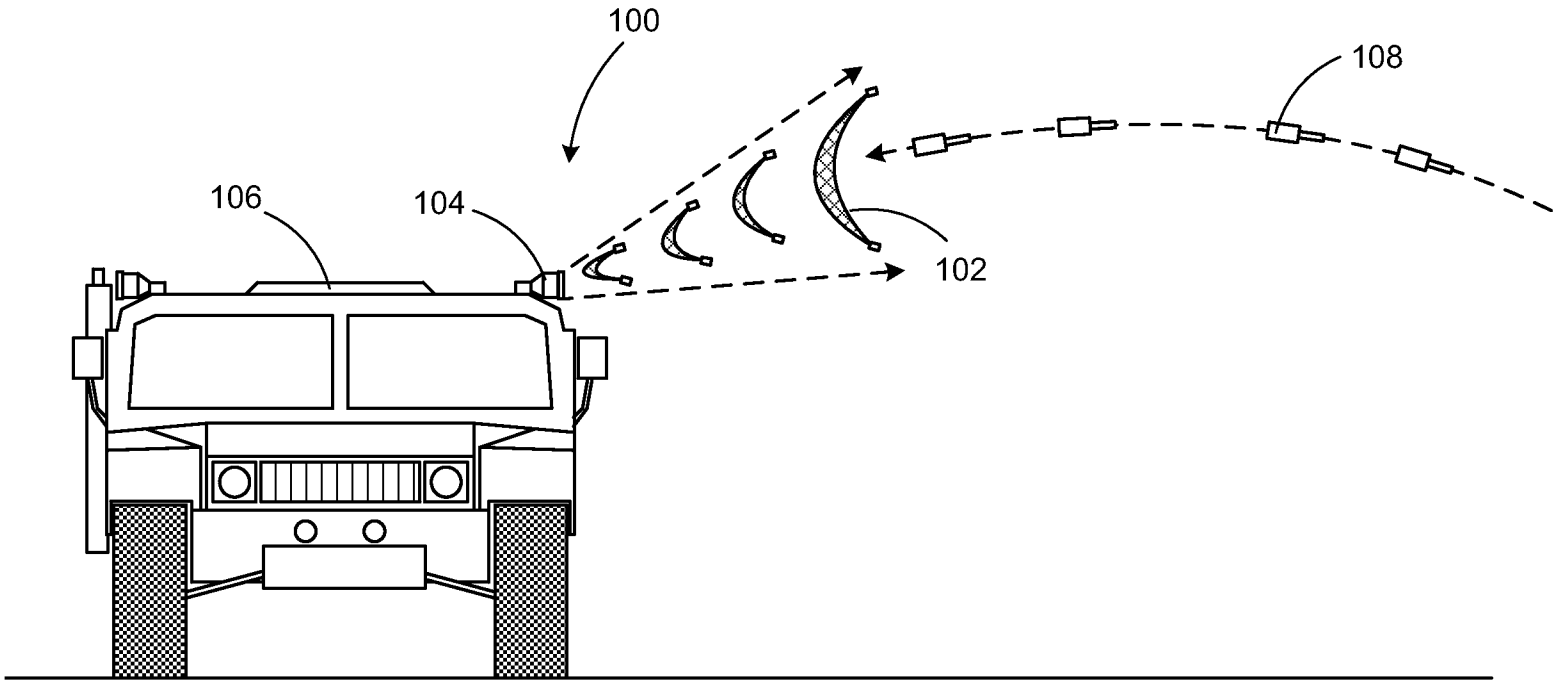
FIG. 1 is an elevational view of a countermeasure system being deployed to intercept an incoming threat according to embodiments presented herein.

In the following detailed description, references are made to the accompanying drawings that form a part hereof, and which are shown by way of illustration, specific embodiments, or examples. Referring now to the drawings, in which like numerals represent like elements through the several figures, a countermeasure system and method will be described. FIG. 1 shows an illustrative view of a countermeasure system 100 mounted to a vehicle 106 and deployed to intercept an incoming threat 108 that is approaching the vehicle 106. According to this example, the incoming threat 108 resembles a handheld shaped charge grenade, such as a RKG-3 grenade. However, it should be understood that the incoming threat 108 may be any grenade, rocket, projectile, or even non-lethal target that is approaching the vehicle 106. For example, according to one embodiment, the countermeasure system 100 may be utilized to prevent hostile personnel from approaching the vehicle 106. So, although the following disclosure will depict and describe the incoming threat 108 as being a grenade or other munitions for illustrative purposes, the embodiments described herein are not limited to any particular threat prevention and are equally applicable to any incoming undesirable target.

Additionally, although the various figures and corresponding disclosure describe the countermeasure system 100 as being installed on a vehicle 106, such as the High Mobility Multipurpose Wheeled Vehicle (or HMMWV or Humvee) depicted in FIG. 1, it should be noted that the countermeasure system 100 may be used with any type of vehicle or even with a fixed structure. For example, it will become clear from the description below of the countermeasure system 100 in conjunction with a vehicle 106 that the countermeasure system 100 would also be useful when mounted on the roof and/or facades of a building in need of protection from incoming threats 108.

Looking at FIG. 1, the countermeasure system 100 includes an expandable countermeasure 102 and a countermeasure launcher 104. Other components of the system will be described below with respect to FIG. 3. The expandable countermeasure 102 is shown in various stages of deployment to intercept the incoming threat 108. The expandable countermeasure 102 is loaded into the countermeasure launcher 104 in a stowed configuration and, when launched, expands as it travels toward the incoming threat 108. When the expandable countermeasure 102 intercepts the incoming threat 108, it "catches" the threat, wrapping around the incoming threat 108 and preventing it from making a direct hit on the vehicle 106.

When the expandable countermeasure 102 intercepts the incoming threat 108, several results may occur. First, the expandable countermeasure 102 may catch the incoming threat 108 and bring it to the ground at a force and/or angle that does not detonate the incoming threat 108. As will be described below, the particular countermeasure launcher(s) 104 selected for firing expandable countermeasure(s) 102 at the incoming threat 108 may be selected according to a desirable intercept angle that would minimize the chance of detonation while maximizing the deflection of the incoming threat trajectory away from the vehicle 106. Another potential outcome of the intercept of the expandable countermeasure 102 with the incoming threat 108 is that the incoming threat 108 detonates from the force of the contact with the expandable countermeasure 102. This detonation is still a favorable result since premature detonation prior to contact with the vehicle 106 would prevent damage to the vehicle 106 and the potential casualties associated with detonation of the incoming threat 108 upon contact with the vehicle 106.

Figure 2:
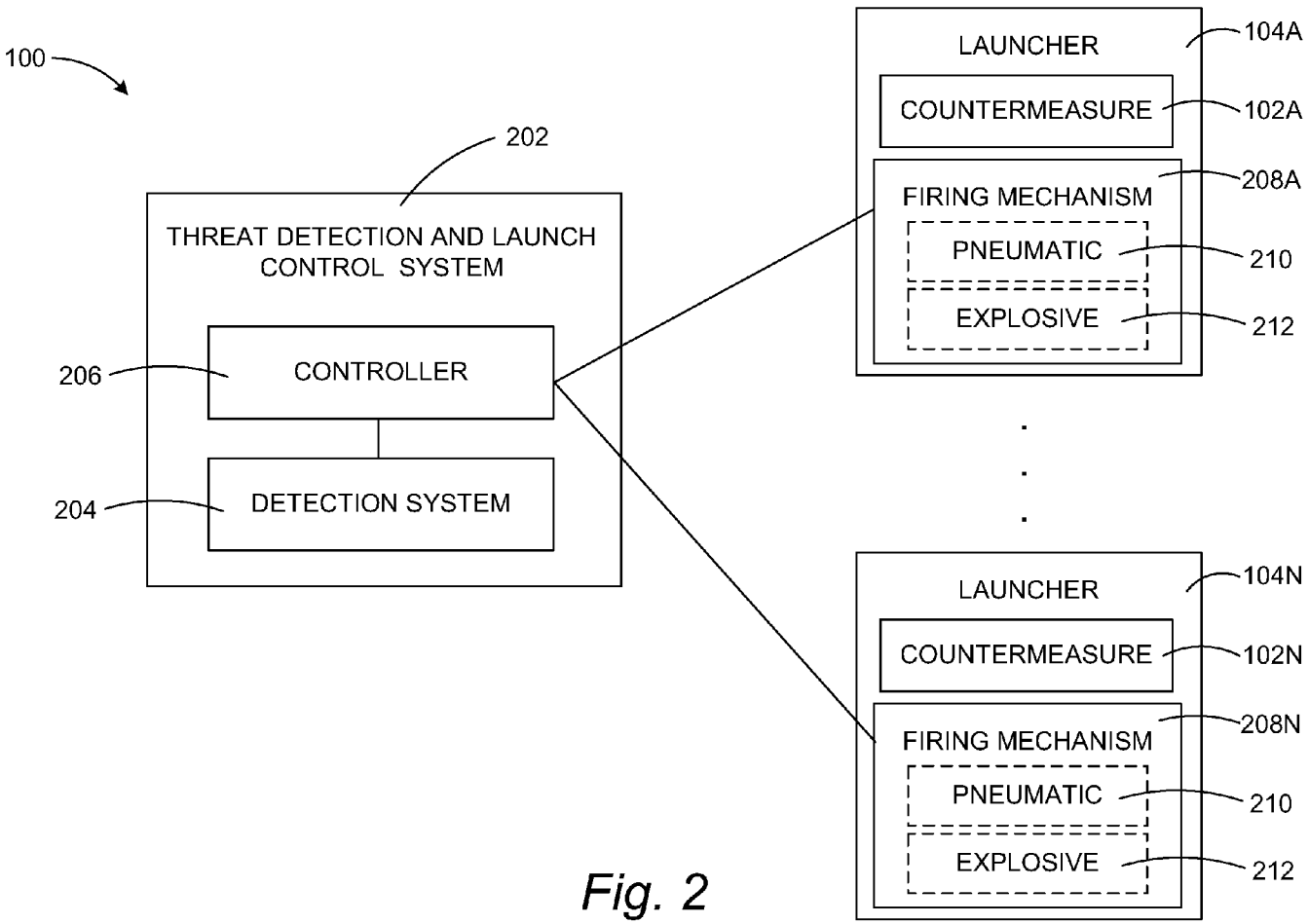
FIG. 2 is a block diagram of a countermeasure system showing the various components of the system according to one embodiment presented herein.

Turning to FIG. 2, the components of a countermeasure system 100 will be described. As described above, the countermeasure system 100 includes a number of countermeasure launchers 104A-104N (collectively referred to as 104) and a number of corresponding expandable countermeasures 102A-102N (collectively referred to as 102). The countermeasure system 100 also includes a threat detection and launch control system 202 that is used to detect the incoming threat(s) 108, to select the appropriate countermeasure launcher(s) 104 for neutralizing the threat, and to launch the corresponding expandable countermeasure(s) 102. According to one embodiment, the threat detection and launch control system 202 includes a detection system 204 and a controller 206.

The detection system 204 may include any radar system, lidar system, optical or acoustic-based sensors, and/or any technology suitable for detecting the presence of an object approaching the vehicle 106. According to one embodiment, the detection system 204 includes a millimeter wave and/or microwave wide field of view (FOV) radar system. The radar system will be discussed in greater detail below with respect to FIG. 3. It should also be appreciated that the threat detection and launch control system 202 may not include a detection system 204. According to this embodiment, the countermeasure system 100 does not actively search for and detect incoming threats 108. Rather, when an operator visually sees an incoming threat 108, then the operator can press a countermeasure launch button or switch (not shown) that is electrically connected to the controller 206, which then launches one or more expandable countermeasures 102 in the manner described below.

There may additionally be a combination of the "automatic" detection system 204 and the "manual" countermeasure launch button. In such an embodiment, the detection system 204 has a manual override mode that allows a user to selectively switch the countermeasure system 100 from an automatic mode that detects incoming threats 108 and launches expandable countermeasures 102 without user input, to a manual mode in which the user initiates expandable countermeasure 102 launching as desired. This feature could be useful in situations where the potential incoming threat 108 changes from a threat of grenades, in which the user would likely want the countermeasure system 100 to detect and react to incoming threats 108 while the user performed other duties, to a hostile crowd situation in which the user might want to selectively determine if and when an expandable countermeasure 102 should be launched at one or more people that approached too closely against warnings to back away.

The threat detection and launch control system 202 communicatively interfaces with a firing mechanism 208A-208N (collectively referred to as 208) associated with each countermeasure launcher 104. When activated, the firing mechanism 208 associated with a countermeasure launcher 104 initiates the launching of the expandable countermeasure 102 from that launcher. Two alternative firing mechanisms 208 will be discussed herein, although it should be understood that any appropriate mechanism for propelling the expandable countermeasures 102 out of the countermeasure launchers 104 may be utilized without departing from the scope of this disclosure. One potential firing mechanism 208 is a pneumatic charge 210, while an alternative firing mechanism 208 is an explosive charge 212. The pneumatic charge 210 and the explosive charge 212 will both be described in greater detail below with respect to FIGS. 5E and 5G and FIGS. 5F and 5H, respectively, when the configurations of the countermeasure launchers 104 are discussed.

The controller 206 may be any computer hardware and/or software containing computer executed instructions for receiving threat detection data from the detection system 204 and, in response, selecting the appropriate countermeasure launchers 104 for neutralizing the incoming threat 108 and triggering the corresponding firing mechanisms 208. As will be discussed in greater detail below, in the case of a pneumatic charge 210, triggering the charge may include operating a pressure valve that releases compressed air or gas into the countermeasure launcher 104 to propel the expandable countermeasure 102 out of the countermeasure launcher 104 toward the incoming threat 108. In the case of an explosive charge 212, triggering may entail providing current to a blasting cap or other detonation trigger to propel the expandable countermeasure 102 out of the countermeasure launcher 104 toward the incoming threat 108.

Figure 3:
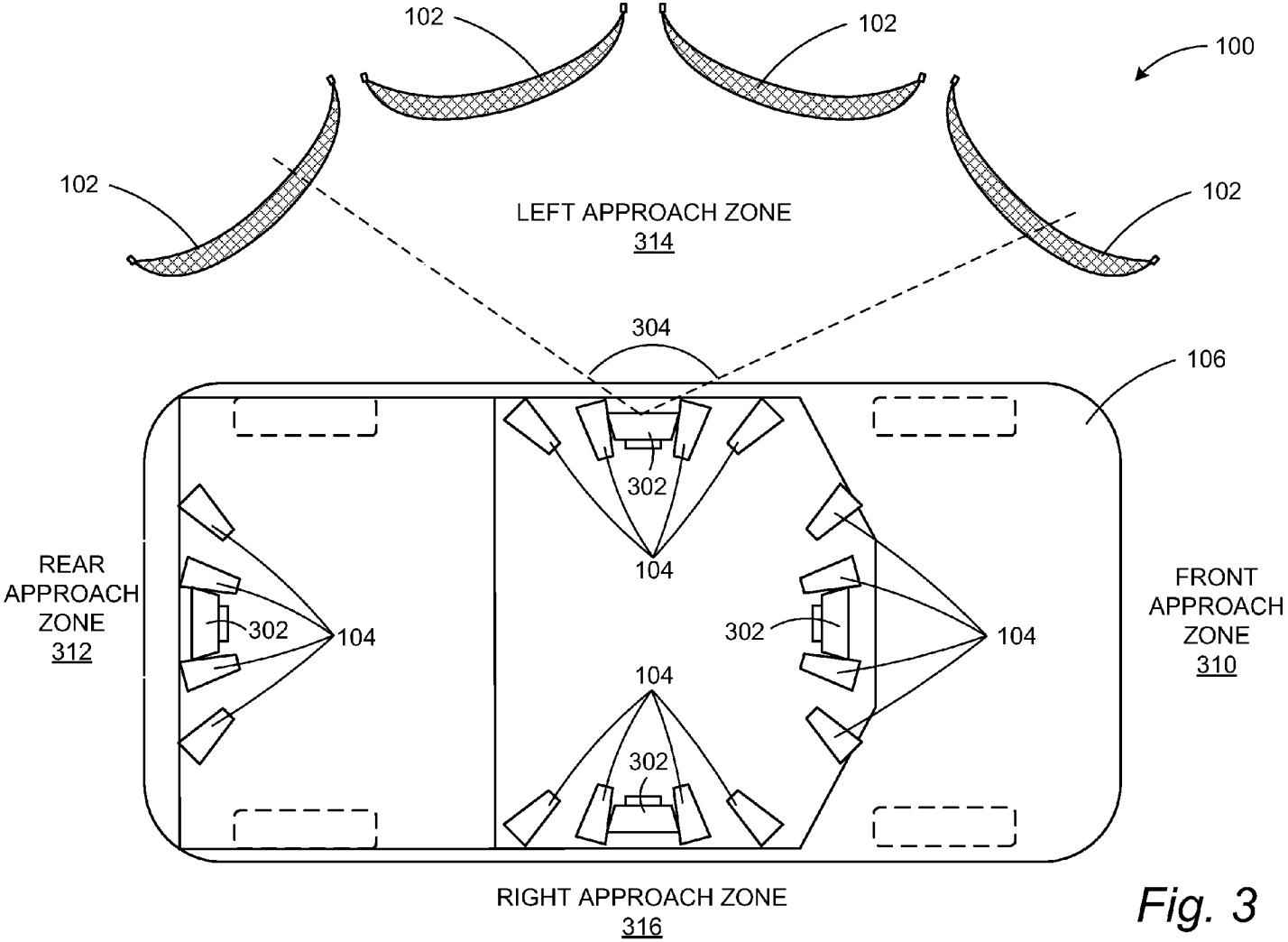
FIG. 3 is a top view of a countermeasure system installed on a vehicle according to one embodiment presented herein.

FIG. 3 shows an overhead view of a countermeasure system 100 mounted to a vehicle 106, with multiple deployed expandable countermeasures 102 shown for illustrative purposes. According to this embodiment, the countermeasure system 100 utilizes a millimeter wave or microwave radar system as the detection system 204 (shown as radar antennas 302). In this example, the radar system includes one radar antenna 302 mounted near the edge on each side of the vehicle roof, providing four radar antennas 302, each with approximately 120 degrees field of view (FOV) 304.

This multi-directional threat protection configuration effectively divides the entire area surrounding the vehicle 106 into four approach zones that are monitored by the four radar antennas 302 and protected by sixteen countermeasure launchers 104. Specifically, the front of the vehicle is protected by the radar antenna 302 facing the front approach zone 310. Four countermeasure launchers 104 are mounted to the front of the vehicle roof and positioned and angled to adequately cover the front approach zone 310 such that the deployed expandable countermeasures 102 from each of the launchers would provide a virtual protective barrier extending outwards approximately three to five meters from the vehicle 106. Similarly, radar antennas 302 and corresponding countermeasure launchers 104 provide protection for the rear approach zone 312, the left approach zone 314, and the right approach zone 316.

It should be understood that the multi-directional threat protection configuration of the countermeasure system 100 shown in FIG. 3 is for illustrative purposes only and is not intended to limit the countermeasure system 100 described herein. Specifically, the FOV 304 coverage as well as the number, type, location, and positioning of the countermeasure launchers 104 and antennas 302, may be altered from that shown in FIG. 3 without departing from the scope of this disclosure. For example, although a number of countermeasure launchers 104 are shown and described as being mounted in fixed positions on the vehicle 106, it is contemplated that a limited number, or even a single launcher, may be utilized on a pivoting and rotating mount and/or on rails or tracks. As such, one or more controllers 206 would be operative to move the one or more countermeasure launchers 104 into position at the optimum firing direction and angle according to the threat detection data provided by the one or more radar systems. It should be appreciated that threat detection data may include any quantity and type of data corresponding to the incoming threat 108 (shown in FIG. 1). Examples include but are not limited to the size, type, position, velocity, vector, acceleration, time to impact, or any other applicable or desirable data associated with the incoming threat 108.

Figure 4:
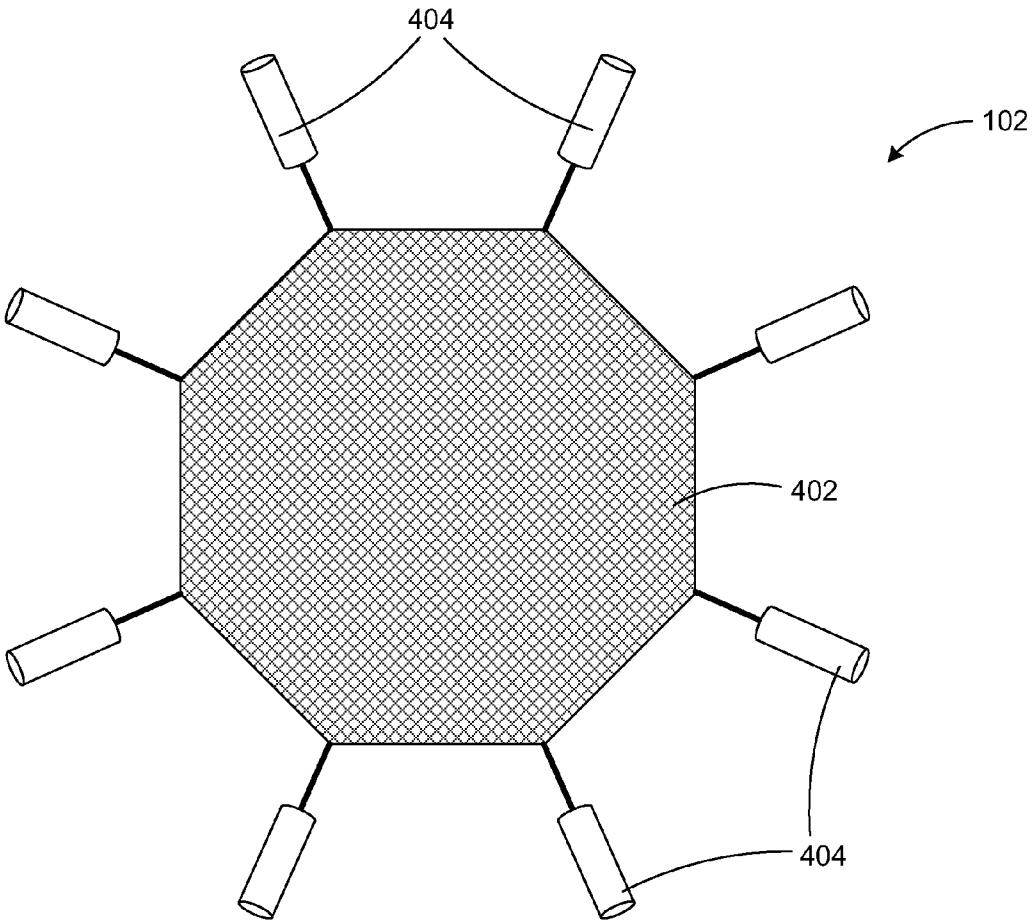
FIG. 4 is a top view of an expandable countermeasure according to one embodiment presented herein.

FIG. 4 shows an expandable countermeasure 102 according to one embodiment. Although the following description discloses one embodiment of the expandable countermeasure 102, it is understood that alternate embodiments of the expandable countermeasure 102 are also included within the scope of the claimed invention. As shown in FIG. 4, the expandable countermeasure 102 includes a flexible receiving body 402 and eight weighted projectiles 404. The flexible receiving body 402 may be made from any material capable of being folded or compressed into a stowed configuration (shown in FIGS. 5E-5H) and expanded to a deployed configuration (shown in FIG. 4), while having sufficient material strength to capture or detonate an incoming threat 108 when launched from the countermeasure launcher 104. Suitable examples of receiving body materials include, but are not limited to, various types of lightweight metals, carbon fiber filaments, monofilament line, nylon, polyethylene, ultra high molecular weight polyethylene, as well as various other polymers, composites and metals, either alone or in combination. The precise material strength values can be easily determined using known techniques. The flexible receiving body 402 may be made from a netting or mesh material that provides the desired strength, minimizes the size of the countermeasure when stowed, and reduces air resistance when deployed.

According to the embodiment shown in FIG. 4, the expandable countermeasure 102 includes eight weighted projectiles 404. As will become clear below when describing the countermeasure launchers 104, the weighted projectiles 404 are sized and shaped for loading into projectile barrels of a corresponding launcher and are attached to the flexible receiving body 402 at locations around the perimeter of the body. The attachment locations may be equidistant from one another, or may be positioned according to any desired configuration according to the shape or configuration of the flexible receiving body 402 and/or the positioning of the corresponding projectile barrels. The weighted projectiles 404 may have substantially cylindrical bodies and may be attached with cord, chain, fasteners, retaining rings, rope or other means of any suitable material, or may be sewn, welded, or otherwise attached directly to the flexible receiving body 402.

As stated above, it should be understood that the depiction of the expandable countermeasure 102 is only one possible configuration for the countermeasure, and numerous other suitable configurations are possible without departing from the scope of this disclosure. For example, the number of weighted projectiles 404 is not limited to eight. Rather, more or fewer weighted projectiles 404 may be used. Additionally, the size and shape of the flexible receiving body 402 may differ. The flexible receiving body 402 shown in FIG. 4 is generally octagonal with a width of approximately three meters; however, the body may be circular, hexagonal, rectangular, square, triangular, or generally any desired shape with any suitable dimensions.

Figure 5A:
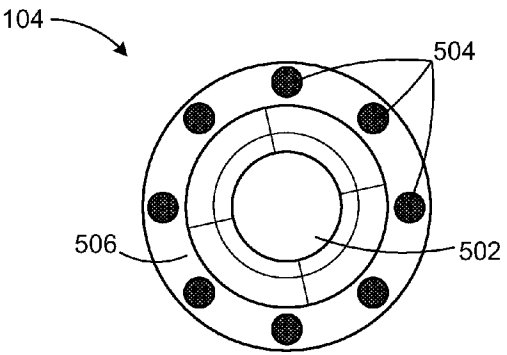
FIG. 5A is a top view of a countermeasure launcher according to one embodiment presented herein.
Figure 5B:
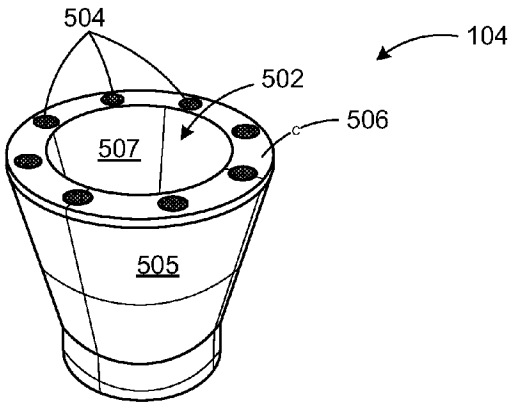
FIG. 5B is a perspective view of a countermeasure launcher according to one embodiment presented herein.
Figure 5C:
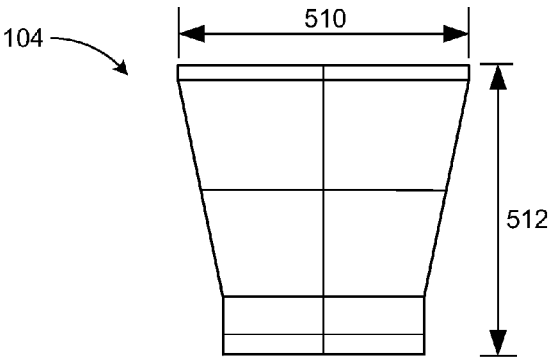
FIG. 5C is a side view of a countermeasure launcher according to one embodiment presented herein.
Figure 5D:
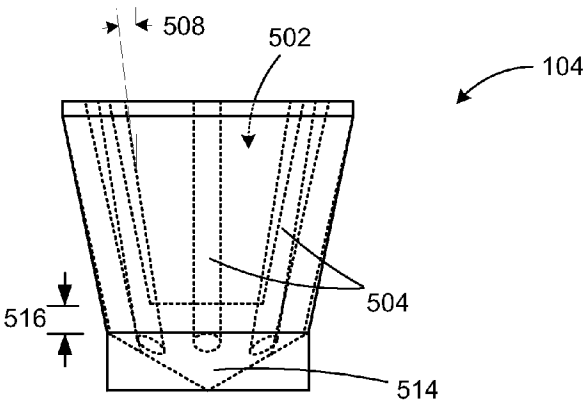
FIG. 5D is a side view of a partially transparent countermeasure launcher showing a cavity and projectile barrels according to one embodiment presented herein.

Turning now to FIGS. 5A-5D, a countermeasure launcher 104 according to various embodiments will now be described. FIG. 5A shows a top view of a countermeasure launcher 104. FIG. 5B shows a perspective view and FIG. 5C shows a side view of the countermeasure launcher 104. FIG. 5D shows the side view with interior components outlined in broken lines for illustrative purposes. Looking at FIGS. 5A-5D, the countermeasure launcher 104 has a cavity 502 for receiving the flexible receiving body 402 of the expandable countermeasure 102 when in a stowed configuration. According to one embodiment, the cavity 502 has an inner diameter that decreases from the cavity exit to the cavity bottom so that the launcher wall 506 tapers inward toward the bottom of the cavity 502. The expanding diameter of the cavity 502 towards the exit of the cavity 502 allows the flexible receiving body 402 of the expandable countermeasure 102 to be stowed within the cavity 502 without inhibiting the egress of the countermeasure 102 from the cavity 502.

There are eight projectile barrels 504 spaced equidistant from one another around the circumference of the cavity 502. As discussed above with respect to the expandable countermeasure 102, the countermeasure launcher 104 may have any number of projectile barrels 504, spaced at varying intervals from each other, corresponding to the number of weighted projectiles 404 attached to the flexible receiving body 402 of the expandable countermeasure 102, as well as to the location of attachment of the weighted projectiles 404 to the flexible receiving body 402. The projectile barrels 504 each have a diameter substantially similar to a corresponding diameter of a corresponding weighted projectile 404 so that an exterior surface of the weighted projectile 404 abuts an interior surface of the projectile barrel 504. The two components are complimentarily sized to allow the weighted projectile 404 to slide within the projectile barrel 504 with minimal friction, while preventing excessive gas escape from around the weighted projectile 404 when fired.

The projectile barrels 504 are angled at diverging angles to direct each of the weighted projectiles at a launch angle 508 from a vertical central axis through a center of the cavity 502 upon countermeasure launch. According to one embodiment, the launch angle 508 is 15 degrees. Other launch angles 508 are possible depending on the size of the expandable countermeasure 102 force of the firing mechanism 208, and distance from the vehicle 106 in which full deployment, or expansion of the flexible receiving body 402, is desired. The countermeasure launcher 104 includes a launcher wall 506. The launcher wall 506 may be formed as a single piece or comprise multiple sections joined together. The launcher wall 506 includes an external surface 505 and an internal surface 507. The external and internal surfaces 505, 507 define the thickness of the launcher wall 506. In general, the launcher wall 506 is of sufficient thickness to contain the projectile barrels 504 with adequate material thickness between the internal surface 507 of the launcher wall 506 and the projectile barrel 504 and, similarly, between the external surface 505 of the launcher wall 506 and the projectile barrel 504. The material thickness between the internal surface 507 and the projectile barrel 504 and the material thickness between the external surface 505 and the projectile barrel 504 may be uniform or variable along the axial length of the launcher wall 506. Similarly, the diameter of each projectile barrel 504 may also be uniform or variable along its axial length. According to one embodiment, the launcher walls 506 are made of one or more of the following: composites; metals including, but not limited to, steel and aluminum; polymers including, but not limited to, polyethylene or other plastics; ceramics or any other suitable material. In one embodiment, the launcher wall 506 has approximately a 0.25 inch thickness on the interior and exterior sides of each projectile barrel 504.

While the countermeasure launcher 104 may be any shape and size without departing from the scope of this disclosure, according to one embodiment, the outer diameter 510 at the exit end of the countermeasure launcher 104 is 5.5 inches, the wall 506 thickness is one inch, each projectile barrel 504 is 0.5 inch in diameter and the height 512 is 4.5 inches. It should be appreciated that there may be additional mounting plates and hardware, not disclosed herein but known to those skilled in the art, for installing the countermeasure launcher 104 on a vehicle 106 or other platform.

As seen in FIG. 5D, the countermeasure launcher 104 includes a lower cavity 514 that is separated from the cavity 502 by a separation depth 516. According to one embodiment, the separation depth is a minimum of 0.25 inches, although other separation depths 516 may be appropriate depending on the firing mechanism 208 and the material of the countermeasure launcher 104.

The lower cavity 514 is fluidly connected to projectile barrels 504 via openings in the bottoms of the projectile barrels 504 where the barrels meet the lower cavity 514. The lower cavity 514 may be shaped as appropriate to efficiently distribute the pressurized air or gas that is utilized with the firing mechanism 208 to propel the weighted projectiles 404 from the projectile barrels 504. A pressure valve may be threaded into an opening (not shown) at the bottom of the lower cavity 514 to prevent damage to the countermeasure launcher 104 from overpressure during countermeasure launch operations.

Figure 5F:
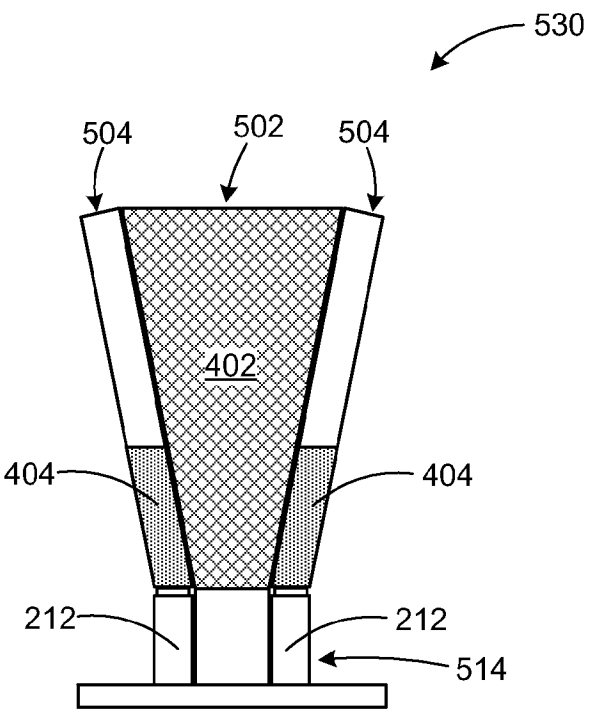
FIG. 5F is a cross-sectional side view of a countermeasure launcher utilizing an explosive charge firing mechanism according to one embodiment presented herein.
Figure 5E:
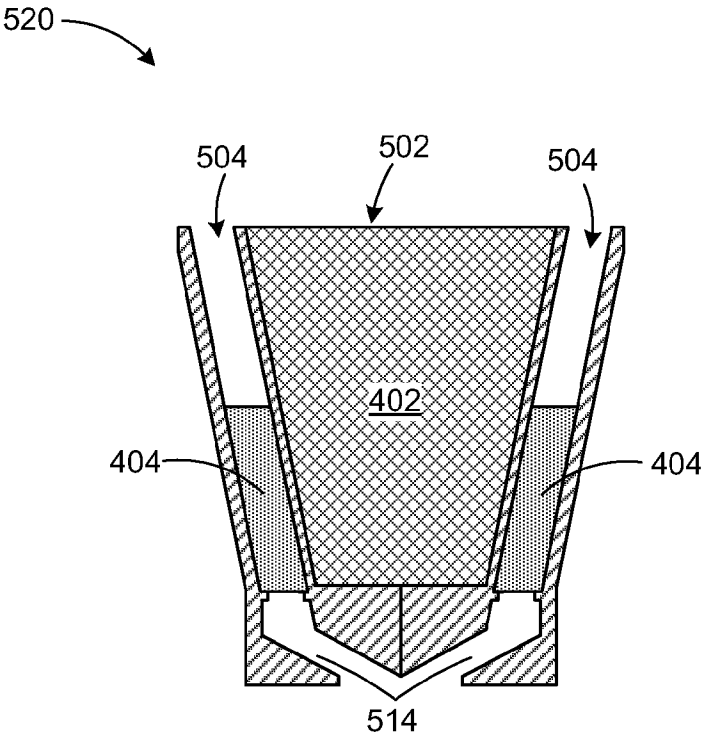
FIG. 5E is a cross-sectional side view of a countermeasure launcher utilizing a pneumatic charge firing mechanism according to one embodiment presented herein.

Referring to FIG. 5E, a countermeasure launcher configuration for use with a particular firing mechanism 208 will be described according to one embodiment. Specifically, FIG. 5E shows a cross-sectional view of a loaded pneumatic countermeasure launcher 520 having a pneumatic charge 210 as the firing mechanism 208. It can be seen that the expandable countermeasure 102 is loaded with the flexible receiving body 402 in a stowed configuration within the cavity 502 with the weighted projectiles 404 inserted into the projectile barrels 504. The lower cavity 514 is fluidly connected to the projectile barrels 504 and to a pressurized gas source (not shown).

According to one embodiment, the pressurized gas used to propel the weighted projectiles 404 from the projectile barrels 504 is compressed air. The compressed air may be stored in one or more storage tanks within the vehicle 106, or within one or more compressed air cartridges. The compressed air cartridges may be self-contained cartridges of compressed air or other gas that may be individually loaded into the countermeasure launcher 520. Alternatively, the compressed air cartridges may be an included component of a expandable countermeasure cartridge discussed below with respect to FIG. 6. The vehicle 106 may have an on-board air compressor for replenishing pressurized air when needed. To trigger the launch of the expandable countermeasure 102, the controller 206 may electrically release an air valve that releases the compressed air or other pressurized gas from the storage tank to the lower cavity 514 if a tank system is used, or may electrically trigger a mechanical or explosive mechanism that punctures or otherwise breaches the associated compressed air cartridge if air cartridges are used.

FIG. 5F shows a cross-sectional view of a loaded explosive charge countermeasure launcher 530 having an explosive charge 212 as the firing mechanism 208. In this embodiment, the lower cavity 514 holds one or more explosive charges 212 that, when detonated, operate to propel the weighted projectiles 404 from the corresponding projectile barrels 504. It should be appreciated that the explosive charge 212 may include an explosive that creates a detonation and associated pressure wave that propels the weighted projectiles 404 from the projectile barrels 504, or may include a gas-generating squib, similar to those used in various applications such as vehicle airbags, to create a large volume of pressurized gas that propels the weighted projectiles 404 out of the launcher.

Figure 5H:
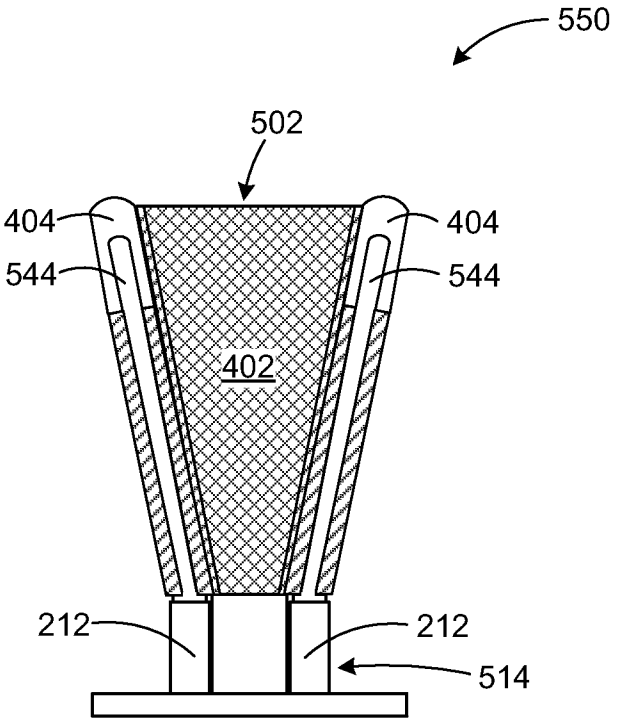
FIG. 5H is a cross-sectional side view of a loaded explosive charge countermeasure launcher according to one embodiment presented herein.
Figure 5G:
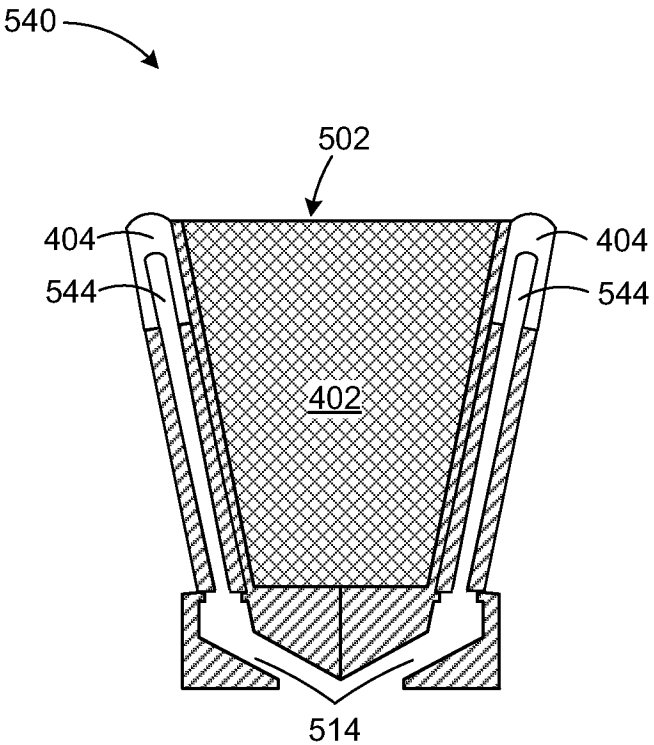
FIG. 5G is a cross-sectional side view of a loaded pneumatic charge countermeasure launcher according to one embodiment presented herein.

FIGS. 5G and 5H show two alternative embodiments, alternative loaded pneumatic charge countermeasure launcher 540 and alternative loaded explosive charge countermeasure launcher 550, respectively. In each of these embodiments, the weighted projectiles 404 slide over an exterior surface of the alternative projectile launchers 544 rather than sliding within projectile barrels 504 as with the previous embodiments described above with respect to FIGS. 5A-5F. The alternative loaded pneumatic charge countermeasure launcher 540 works with a pneumatic charge 210 as the firing mechanism 208 in the same way as previously described. The difference is that the compressed air or gas travels through the alternative projectile launchers 544 to a projectile cavity inside each of the weighted projectiles 404, forcing the weighted projectiles upward off of the alternative projectile launchers.

Similarly, the alternative loaded explosive charge countermeasure launcher 550 works with an explosive charge 212 as the firing mechanism 208 in the same way as previously described. The difference is that the explosive force of the detonation of the explosive charge, provides a pressure wave or compressed gas that travels through the alternative projectile launchers 544 to a projectile cavity inside each of the weighted projectiles 404, forcing the weighted projectiles upward off of the alternative projectile launchers.

Figure 6:
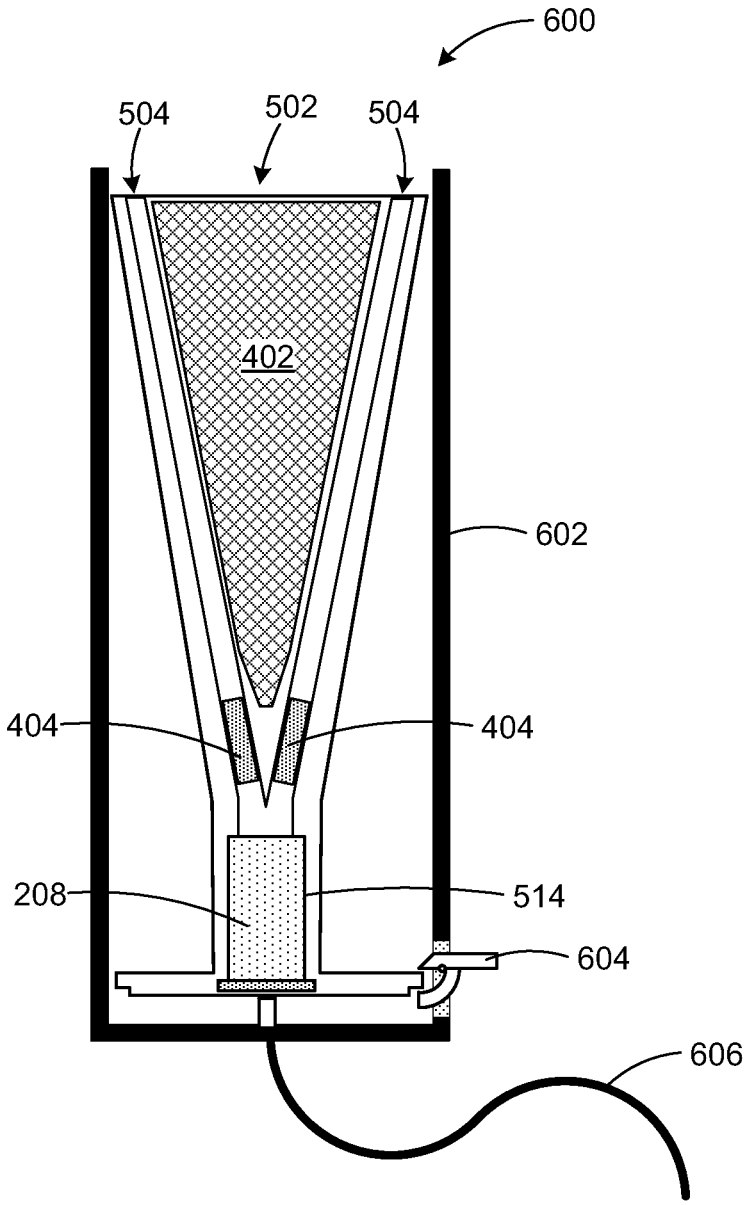
FIG. 6 is a cross-sectional side view of a countermeasure cartridge according to one embodiment presented herein.

To load the expandable countermeasure 102 within the countermeasure launchers 104, the flexible receiving bodies 402 may be manually packed and stowed within the cavities 502 of the launchers. The weighted projectiles 404 are then slid into the projectile barrels 504 or over the alternative projectile launchers 544. Alternatively, as shown in FIG. 6, the expandable countermeasures 102 may be packaged along with a countermeasure launcher 104 as a self-contained cartridge 600 that is quickly and easily loaded into launch container 602 that is attached to the vehicle 106 or other structure to be protected. In this embodiment, the self-contained cartridge 600 may include the components of the countermeasure launcher 104 previously described, such as a cavity 502 and projectile barrels 504 or alternative projectile launchers 544, which come pre-loaded with an expandable countermeasure 102. The self-contained cartridge 600 may be slid into the launch container 602 and secured in place with the fastening mechanism 604. It should be appreciated that the exterior surface of the self-contained cartridge 600 may be cylindrical or complimentarily shaped and sized according to the interior shape and size of the launch container 602.

According to this embodiment, the firing mechanism 208 is included within the self-contained cartridge 600 and may plug into a receptacle in the bottom of the launch container 602 when the cartridge 600 is pushed into place. If the firing mechanism 208 is a pneumatic charge 210, then the compressed air cartridge that is pre-loaded within the lower cavity 514 of the cartridge 600 includes some electrical firing mechanism that is electrically connected to the controller 206 via wiring 606. The electrical firing mechanism may be a valve, explosive charge, or electro-mechanical puncturing device that is operative to release the air from the compressed air cartridge to the lower cavity 514 and to the projectile barrels 504. If the firing mechanism 208 is an explosive charge 212, then the blasting cap or other explosive detonation device is electrically connected to the controller 206 via the wiring 606.

Figure 7:
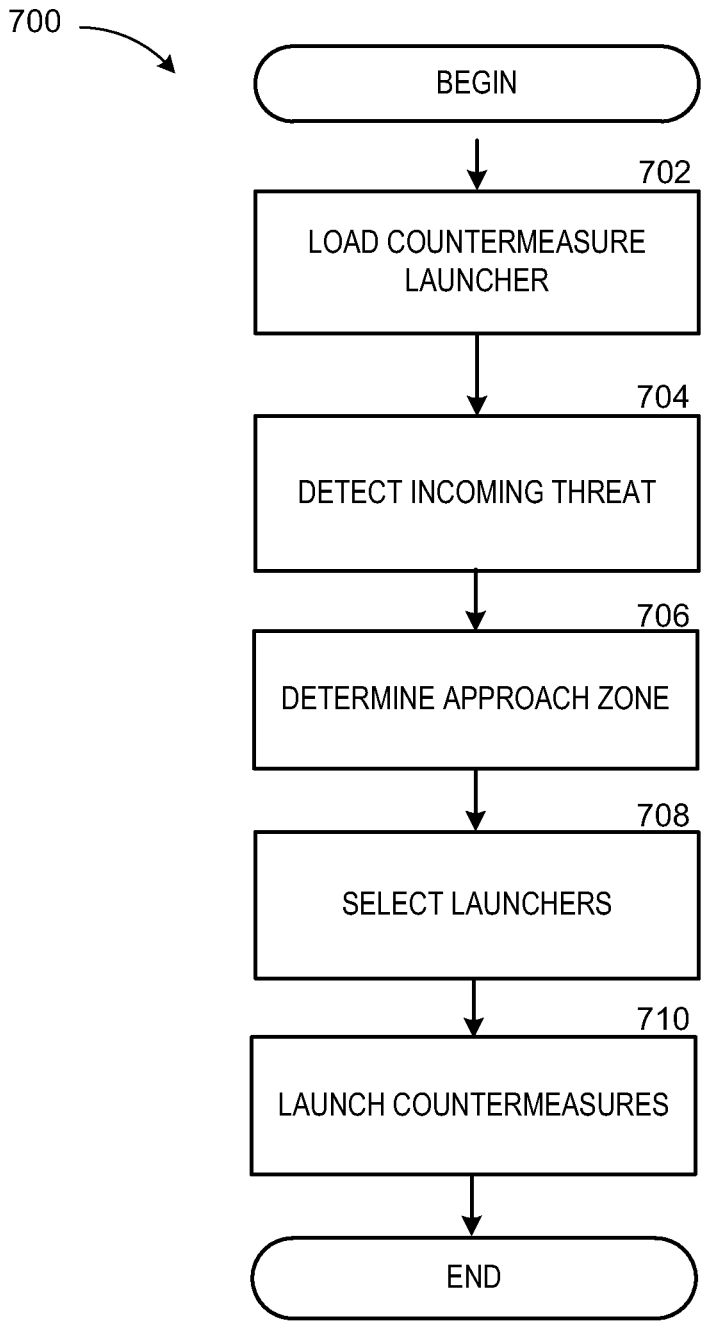
FIG. 7 is a flow diagram illustrating a method for neutralizing an incoming threat to a vehicle with a countermeasure according to various embodiments presented herein.

Turning to FIG. 7, an illustrative routine 700 for neutralizing an incoming threat will now be described in detail. It should be appreciated that more or fewer operations may be performed than shown in the FIG. 7 and described herein. Moreover, these operations may also be performed in a different order than those described herein. The routine 700 begins at operation 702, where the countermeasure launchers 104 are loaded. As described above, this may be include loading the flexible receiving body 402 and weighted projectiles 404 of the expandable countermeasure 102 independently in each countermeasure launcher 104, or may include loading a single cartridge 600 within each launch container 602.

From operation 702, the routine 700 continues to operation 704, where an incoming threat 108 is detected. The detection may occur with the detection system 204, such as a radar system, or may be a visual detection from an occupant of the vehicle 106. If it is a visual detection without the use of a detection system 204, then the remaining operations are performed by a user rather than the controller 206. The remaining description of the routine 700 assumes controller-directed operations. At operation 706, the controller 206 determines the applicable approach zone of the incoming threat 108. The appropriate countermeasure launchers 104 are then selected according to the determined approach zone of the incoming threat 108 at operation 708. This operation may include determining appropriate launching angles and positions for the countermeasure launchers 104 if one or more launchers are capable of rotation and angular repositioning as described above. The routine 700 continues from operation 708 to operation 710, where the controller 206 triggers the appropriate firing mechanism 208 of the selected countermeasure launchers 104, launching the weighted projectiles 404 out of the projectile barrels 504, or off of the alternative projectile launchers 544. The weighted projectiles 404 consequently pull the flexible receiving body 402 out of the cavity 502 to intercept the incoming threat 108. The routine 700 ends.

It should be clear from the disclosure above that the technologies described herein provide for an effective system and method for intercepting incoming threats 108 without increasing the weight of a vehicle 106 or complicating vehicle ingress and egress. The countermeasure systems 100 described herein significantly enhance the safety of armed forces while remaining minimally intrusive and having no impact on the capabilities of the vehicles 106 to which the systems are mounted, as well as requiring minimal input from the occupants of the vehicles 106. It should be understood that the systems described above may be scaled up to counter any threats, such as rocket powered grenades or other high-speed and high explosive rockets or munitions.

The subject matter described above is provided by way of illustration only and should not be construed as limiting. Various modifications and changes may be made to the subject matter described herein without following the example embodiments and applications illustrated and described, and without departing from the true spirit and scope of the present invention, which is set forth in the following claims.

What is claimed is:

1. A countermeasure system, comprising:

an expandable countermeasure having a flexible receiving body and a plurality of weighted projectiles;

a countermeasure launcher configured for attachment to a platform and for receiving the expandable countermeasure in a stowed configuration, the countermeasure launcher comprising:

a cavity sized to receive the flexible receiving body of the expandable countermeasure in the stowed configuration, a plurality of projectile barrels surrounding the cavity, the plurality of projectile barrels configured to receive the plurality of weighted projectiles and to direct each of the weighted projectiles at a launch angle from a central axis through a center of the cavity upon countermeasure launch, and a firing mechanism communicatively connected to a threat detection and launch control system and fluidly connected to the plurality of projectile barrels such that when triggered by the threat detection and launch control system, the firing mechanism is operative to propel the plurality of weighted projectiles out of the plurality of projectile barrels; and the threat detection and launch control system comprising a radar system operative to detect an incoming threat and, in response, the threat detection and launch control system operative to trigger a launch of the expandable countermeasure from the countermeasure launcher.

2. The countermeasure system of claim 1, wherein the flexible body of the expandable countermeasure comprises a mesh material.

3. The countermeasure system of claim 1, wherein the expandable countermeasure and the countermeasure launcher comprise:

a cartridge configured for loading within a launch container; and the launch container configured for attachment to the platform, wherein the cartridge comprises the expandable countermeasure stowed within a cavity and a plurality of projectile barrels, and a firing mechanism configured for connection to the threat detection and launch control system upon loading of the cartridge within the launch container.

4. The countermeasure system of claim 1, wherein the plurality of weighted projectiles are attached at a plurality of positions around a perimeter of the flexible receiving body.

5. The countermeasure system of claim 4, wherein the plurality of weighted projectiles comprises 8 weights having substantially cylindrical bodies.

6. The countermeasure system of claim 1, further comprising a lower cavity positioned below the cavity and the plurality of projectile barrels, wherein the firing mechanism is fluidly connected to the plurality of projectile barrels via the lower cavity.

7. The countermeasure system of claim 6, wherein the firing mechanism comprises a pneumatic charge such that the threat detection and launch control system is operative to trigger the pneumatic charge to provide pressurized air to the plurality of projectile barrels via the lower cavity and propel the plurality of weighted projectiles out of the plurality of projectile barrels.

8. The countermeasure system of claim 6, wherein the firing mechanism comprises an explosive charge such that the threat detection and launch control system is operative to trigger the explosive charge to provide pressurized gas to the plurality of projectile barrels via the lower cavity and propel the plurality of weighted projectiles out of the plurality of projectile barrels.

9. The countermeasure system of claim 1, wherein the plurality of projectile barrels comprises eight projectile barrels spaced around the cavity and each having a diameter substantially similar to a corresponding diameter of a weighted projectile such that an exterior surface of the weighted projectile abuts an interior surface of the projectile barrel while allowing the weighted projectile to slide within the projectile barrel.

10. The countermeasure system of claim 1, wherein the launch angle comprises approximately 15 degrees.

11. The countermeasure system of claim 1, wherein the threat detection and launch control system further comprises a controller operative to receive threat detection data from the radar system and, in response, to trigger the firing mechanism to launch the expandable countermeasure from the countermeasure launcher.

12. A countermeasure system, comprising:

a plurality of expandable countermeasures, each expandable countermeasure comprising a flexible receiving body and a plurality of weighted projectiles attached to a plurality of locations around a perimeter of the flexible receiving body; and a plurality of countermeasure launchers configured for attachment to a platform according to a multi-directional threat protection configuration, each countermeasure launcher comprising a cavity sized to receive the flexible receiving body of an expandable countermeasure in a stowed configuration, a plurality of projectile barrels surrounding the cavity, the plurality of projectile barrels configured to receive the plurality of weighted projectiles of the expandable countermeasure and to direct each of the weighted projectiles at a launch angle away a central axis through a center of the cavity upon countermeasure launch, and a firing mechanism fluidly connected to the plurality of projectile barrels such that when activated, the firing mechanism is operative to propel the plurality of weighted projectiles out of the plurality of projectile barrels.

13. The countermeasure system of claim 12, further comprising:

a radar system operative to detect an incoming threat; and a controller operative to receive threat detection data from the radar system and, in response, to trigger the firing mechanism to launch the expandable countermeasure from the countermeasure launcher.

14. The countermeasure system of claim 13, wherein the controller is further operative to select one or more countermeasure launchers for intercepting the incoming threat from the threat alert data and, in response, to trigger the firing mechanism to launch one or more selected countermeasure launchers.

15. The countermeasure system of claim 12, further comprising:

a user-initiated trigger communicatively linked to the firing mechanism and operative to receive a user input corresponding to a launch request for at least one of the plurality of countermeasure launchers and, in response, to trigger the firing mechanism associated with the at least one of the plurality of countermeasure launchers.

16. A countermeasure system, comprising:

an expandable countermeasure having a flexible receiving body and a plurality of weighted projectiles;

a countermeasure launcher configured for attachment to a platform and for receiving the expandable countermeasure in a stowed configuration, the countermeasure launcher comprising:

a cavity sized to receive the flexible receiving body of the expandable countermeasure in the stowed configuration, a plurality of projectile launchers surrounding the cavity, the plurality of projectile launchers configured to receive the plurality of weighted projectiles such that the plurality of weighted projectiles slide over an exterior surface of the projectile launchers, and to direct each of the weighted projectiles at a launch angle from a central axis through a center of the cavity upon countermeasure launch, and a firing mechanism communicatively connected to a threat detection and launch control system and fluidly connected to the plurality of projectile launchers such that when triggered by the threat detection and launch control system, the firing mechanism is operative to propel the plurality of weighted projectiles off of the plurality of projectile launchers; and the threat detection and launch control system comprising a radar system operative to detect an incoming threat and, in response, the threat detection and launch control system operative to trigger a launch of the expandable countermeasure from the countermeasure launcher.

* * * * *